US005165739A

United States Patent [19]

Liu

[11] Patent Number: 5,165,739

[45] Date of Patent: Nov. 24, 1992

[54] DOOR LATCH

[76] Inventor: Tai-Ping Liu, No. 15, Alley 8, Lane 3, Kuochi St., Lungching Hsiang, Taichung Hsien, Taiwan

[21] Appl. No.: 805,304

[22] Filed: Dec. 10, 1991

[51] Int. Cl.[5] ..... E05C 1/16

[52] U.S. Cl. ..... 292/169.23; 292/337

[58] Field of Search ..... 292/358, 359, 169.23, 292/169, 337, 169.22, 169.21, 169.19

[56] References Cited

U.S. PATENT DOCUMENTS 1,838,340 12/1931 Weaver ..... 292/169.23 X
3,042,437 7/1962 Duvall ..... 292/169.23 X
3,128,116 4/1964 Patriquin et al. ..... 292/358
3,580,622 5/1971 Morgan ..... 292/359 X
4,062,579 12/1977 Porter et al. ..... 292/348

*Primary Examiner*—Richard E. Moore
*Attorney, Agent, or Firm*—Patterson & Keough

[57] ABSTRACT

A door latch including a spindle engaged between two knobs and rotated with the knobs, a housing formed in the knobs, a case having one end engaged in the housing, a stop engaged in the case, a latch bolt engaged in the case and including a head movable outward of the case and a pair of arms having a camway for engagement with the spindle so that the head can be pushed inwards of the case, and a spring engaged between the stop and the head for biasing the head out of the case when the spindle no longer acts on the camways of the arms.

2 Claims, 2 Drawing Sheets

DOOR LATCH

BACKGROUND OF THE INVENTION

1. Field of the Invention

The present invention relates to a latch, and more particularly to a door latch.

2. Description of the Prior Art

One type of door latch is disclosed in U.S. Pat. No. 4,062,579 to Potter et al. In Potter et al., the door latch comprises a case 30 including two spring legs 123 formed therein, a latch bolt 31 engageable in the case 30 and including two ramps 128 formed therein, and a spindle 32 engaged between the outside knob 26 and the inside knob 28 and capable of acting on the camways 116, 119 so as to pull the latch bolt head 111 inwards of the case 30. The spring legs 123 slidably engage on the ramps 128 of the latch bolt 31 so as to push the latch bolt head 111 outwards of the case 30.

However, it is very difficult to form the spring legs 123 which extend slightly inwards of the case 30, so that the manufacturing processes are complicated and the manufacturing cost is increased. In addition, since the spring legs 123 act on the ramps 128, most of the forces of the spring legs 123 exerted on the ramp are dissipated, and only part of the forces can be used for biasing the latch bolt head 111 outwards of the case 30, so that the spring legs 123 are required to form with great and sufficient resilient force. Furthermore, the spring legs 123 are apt to be broken.

The present invention has arisen to mitigate and/or obviate the afore-described disadvantages of the conventional door latches.

SUMMARY OF THE INVENTION

The primary objective of the present invention is to provide a door latch in which the latch bolt head can be easily biased outwards of the case.

In accordance with one aspect of the invention, there is provided a door latch including a spindle engaged between two knobs and rotated with the knobs, a housing formed in the knobs and including an open end, housing and having the other end extended outward of the housing, a stop engaged in the case, a latch bolt engaged in the case and including a latch bolt head movable outward of the case and a pair of arms having a free end located in the housing, each of the free ends of the arms including a camway for engagement with the spindle when the knobs are rotated, the stop being disposed between the arms of the latch bolt, and a spring engaged between the stop and the latch bolt head for biasing the latch bolt head out of the case, whereby, the latch bolt head can be pushed inwards of the case against the spring when the camways of the arms are pushed by the spindle, and the latch bolt head can be pushed outwards of the case when the spindle no Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
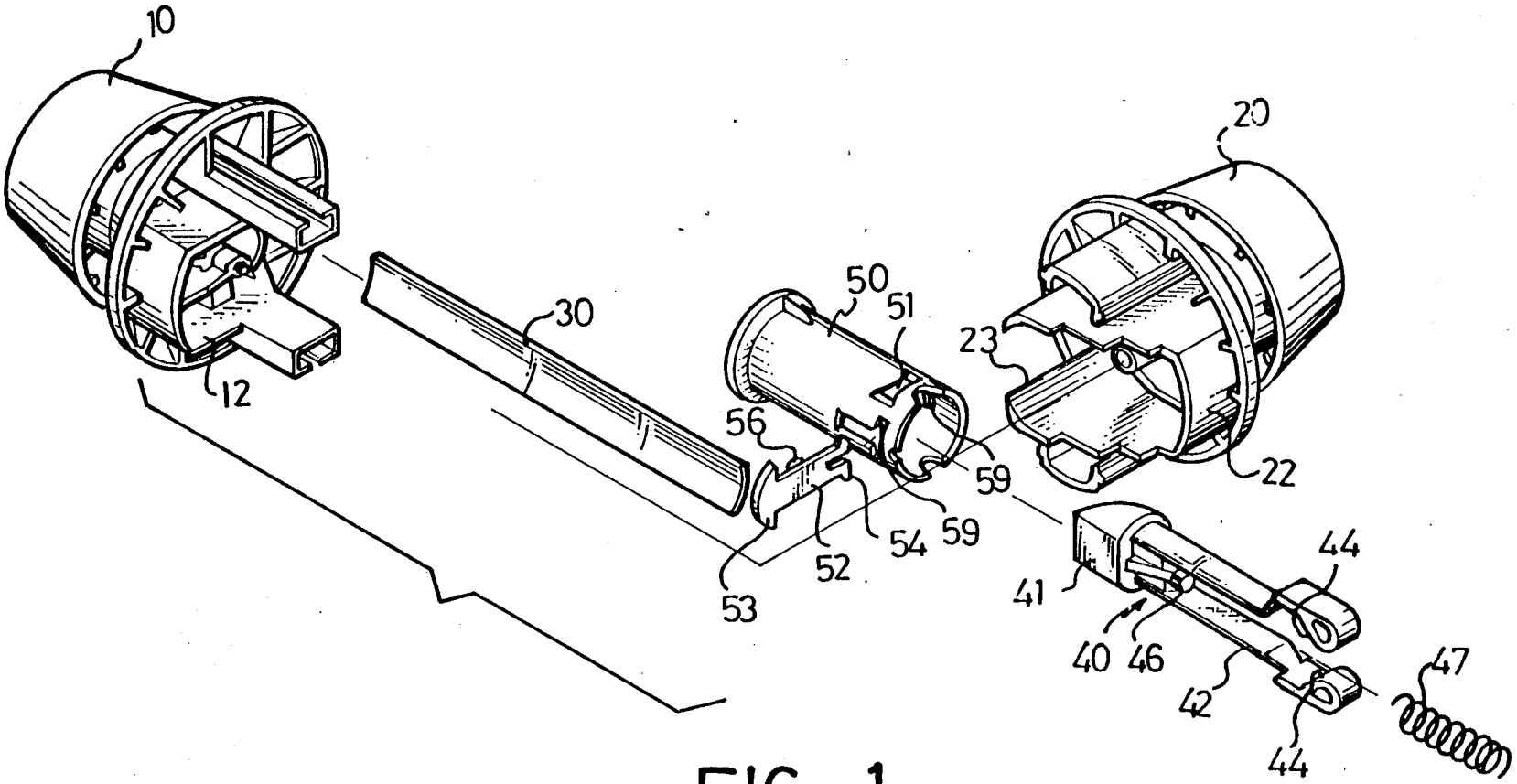
FIG. 1 is an exploded view of a door latch in accordance with the present invention.

Referring to the drawings, a door latch in accordance with the present invention comprises generally a first knob 10, a second knob 20, and a spindle 30 engaged between the knobs 10, 20 and can be rotated by the knobs 10, 20. The first knob 10 and the second knob 20 each includes a housing 12, 22 formed therein. The housing 22 includes an open end having two space for accommodating the latch bolt 40 which includes a latch bolt head 41 and a pair of arms 42, each of the arms 42 includes a camway 44 formed in the free end thereof. The latch bolt 40 includes a stub 46 formed between the arms 42 and close to the latch bolt head 41. A spring 47 includes a first end engaged on the stub 46.

A case 50 includes two slots 51 oppositely formed in a first end thereof for engagement with the edges 23 of the housing 22 and includes a second end extended outward of the housings 12, 22. The latch bolt 40 is engaged in the case 50 and latch bolt head 41 is extendible outwards of the case 50. The first end of the case 50 further includes two notches 59 oppositely formed therein and separated from the slots 51. A stop 52 which is engageable in the notches 59 of the case 50 includes an enlarged member 53 formed on the first end thereof for engagement on the case 50 and for limiting the relative movement of the stop 52 to the case 50, and includes a second end 54 which bifurcated so as to form two spring legs. The stop 52 is located between the arms 42 of the latch bolt 40 and includes a protrusion 56 formed on one side thereof. The spring 47 has a second end engaged on the protrusion 56 of the stop 52 so that the latch bolt head 41 can be biased outwards of the case 50 (FIG. 3).

Figure 3:
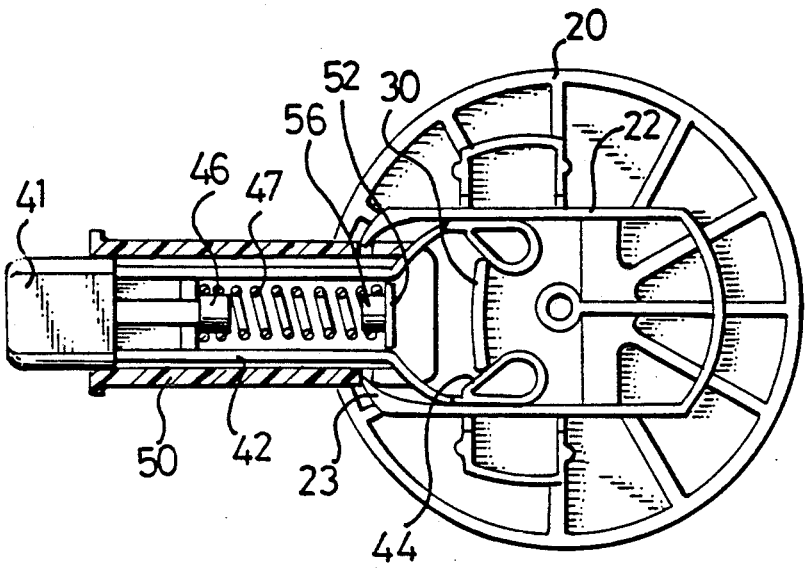
FIGS. 2 and 3 are cross sectional views illustrating the operations of the door latch.
Figure 2:
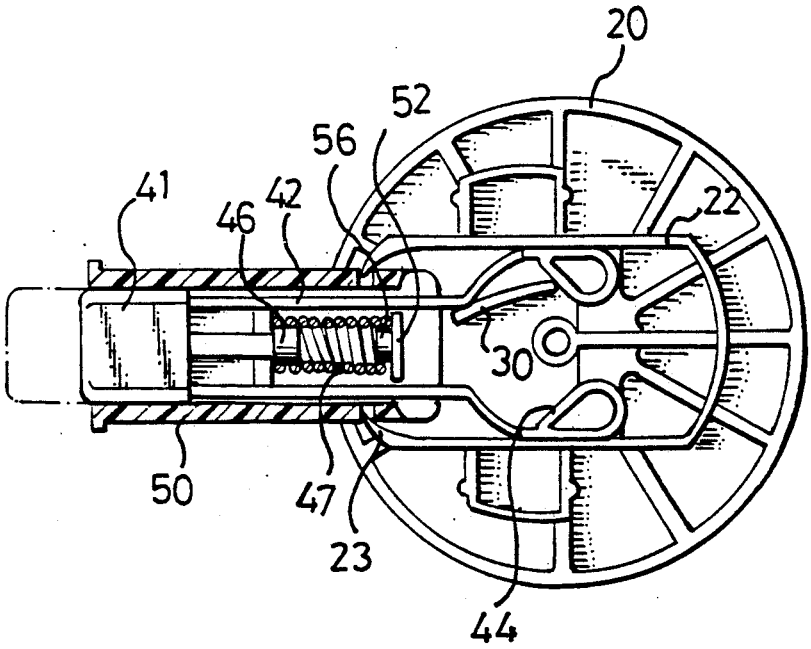

In operation, as shown in FIGS. 2 and 3, the spindle 30 is caused to engage with the camways 44 of the latch bolt 40 when the spindle 30 is rotated by the knobs 10, 20 so that the latch bolt 40 can be pushed inwards of the case 50 against the spring 47 (FIG. 2). When the spindle 30 is rotated backwards to the position as shown in FIG. 3, the latch bolt 40 is released and the latch bolt head 41 can be pushed outwards of the case 50 by the spring 47.

Accordingly, no spring legs are required to be formed in the case 50 so that the case 50 can be easily , manufactured In addition, the latch bolt 40 can be easily biased by the spring 47, the resilient force of the spring 47 will not be dissipated. Therefore, the door latch can be operated effectively and the manufacturing cost thereof is greatly decreased.

Although this invention has been described with a certain degree of particularly, it is to be understood that the present disclosure has been made by way of example only and that numerous changes in the detailed construction and the combination and arrangement of parts may be resorted to without departing from the spirit and scope of the invention as hereinafter claimed.

I claim:

1. A door latch comprising a first knob, a second knob, a spindle engaged between said first knob and said second knob and can be rotated by said first knob and said second knob, said second knob including a housing formed therein, said housing including an open end, a case including a first end engaged in said open end of said housing and including a second end extended outward of said housing, two notches oppositely formed in said first end of said case, a stop engaged in said notches of said case and including an enlarged member formed on a first end thereof for engagement with one of said notches of said case and for limiting relative movement between said stop and said case, and including a bifurcated second end for engagement with the other of said notches of said case, a latch bolt engaged in said case and including a latch bolt head and a pair of arms formed integral with each other, said latch bolt head being movable outwards of said case, each of said arms including a free end extended outward of said case and located in said housing of said second knob, each of said free ends of said arms including a camway formed thereon and engageable with said spindle when said first knob and said second knob are rotated, said stop being disposed between said arms of said latch bolt, and a biasing means engaged between said stop and said latch bolt head for biasing said latch bolt head out of said case, whereby, said latch bolt head is pushed inwards of said case against said biasing means when said camways of said arms are pushed by said spindle, and said latch bolt head is pushed outwards of said case when said spindle no longer acts on said camways of said arms.

2. A door latch according to claim 1, wherein said stop includes a protrusion formed thereon, said latch bolt includes a stub formed integral thereon and located between said arms, said biasing means is a spring having a first end engaged with said stub of said latch bolt and having a second end engaged with said protrusion of said stop so that said biasing means can be retained in place.

* * * * *

UNITED STATES PATENT AND TRADEMARK OFFICE

CERTIFICATE OF CORRECTION

PATENT NO. : 5,165,739

DATED : November 24, 1992

INVENTOR(S) : Tai-Ping Liu

It is certified that error appears in the above-identified patent and that said Letters Patent is hereby corrected as shown below:

Col. 1, line 58, after "no" insert -- longer acts on the camways of the arms. --

Col. 2, line 10, after "two" insert -- edges 23 formed thereon. The housings 12, 22 form a --

Col. 2, line 46, after "manufactured" insert --.--

Signed and Sealed this

Twenty-sixth Day of October, 1993

*Attest:*

Bruce Lehman

BRUCE LEHMAN

*Attesting Officer*

*Commissioner of Patents and Trademarks*